United States Patent [19]

Van Hovel

[11] Patent Number: 4,939,799

[45] Date of Patent: Jul. 10, 1990

[54] PORTABLE, TRAVELER'S BATH SEAT

[75] Inventor: Brian V. Van Hovel, Phoenix, Ariz.

[73] Assignee: At Ease Enterprises, Inc., Phoenix, Ariz.

[21] Appl. No.: 344,677

[22] Filed: Apr. 28, 1989

[51] Int. Cl.[5] ..... A47K 3/022; A47K 3/12

[52] U.S. Cl. ..... 4/578; 4/579; 4/559

[58] Field of Search ..... 4/578, 571, 579, 559, 4/611, 661; 297/252

[56] References Cited

U.S. PATENT DOCUMENTS

| | | | |
|---|---|---|---|
| 736,032 | 8/1903 | Silver | 4/579 |
| 799,371 | 9/1905 | Eustis | 4/579 |
| 2,588,562 | 3/1952 | Parish | 4/579 |
| 2,813,276 | 11/1957 | Lanza | 4/579 |
| 2,852,785 | 9/1958 | Mikola | 4/579 |
| 4,656,678 | 4/1987 | Lipski | 4/559 X |

FOREIGN PATENT DOCUMENTS

| | | | |
|---|---|---|---|
| 164757 | 8/1955 | Australia | 4/579 |

*Primary Examiner*—Henry K. Artis

[57] ABSTRACT

A traveler's extendable bath seat is made up of two parts, the first of which is a carrying case in which the second is stored and transported. When so stored the bath seat is small enough to be carried in a briefcase or luggage. The two parts are slide coupled so that the overall length of the combination can be extended to span a bathtub. Safety locking devices are included to maintain the extendible bath seat at a fixed length and to restrain it in position atop the tub.

15 Claims, 1 Drawing Sheet

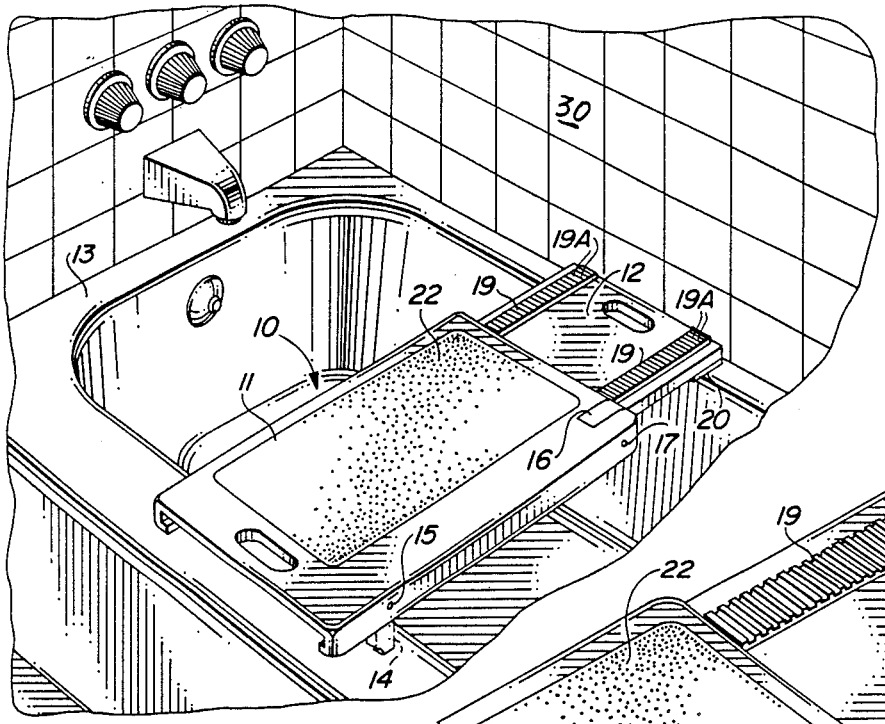
FIG. 1
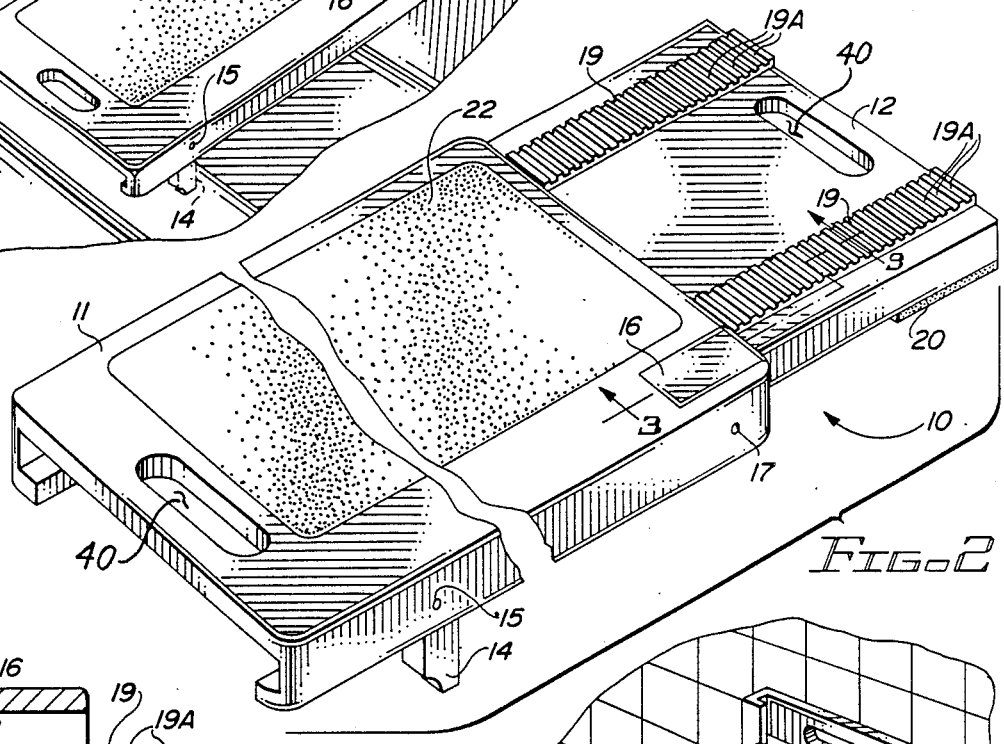
FIG. 2
FIG. 4
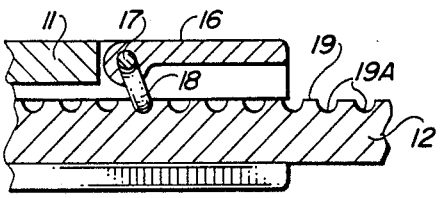
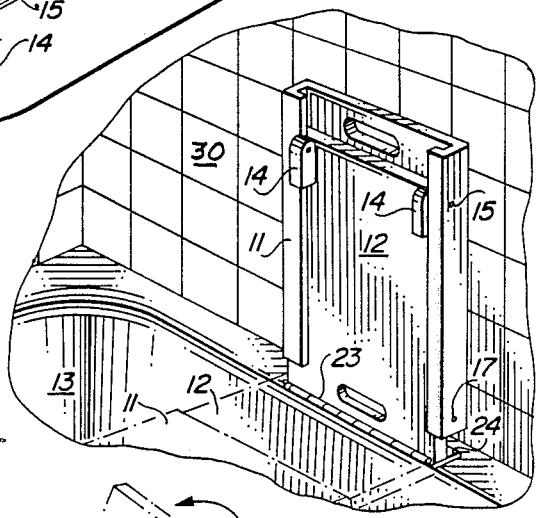
FIG. 6
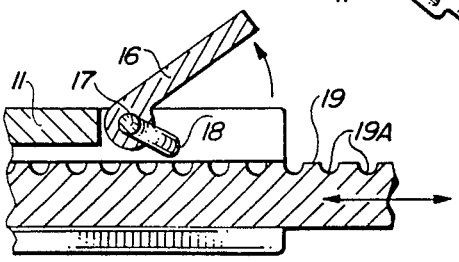
FIG. 5
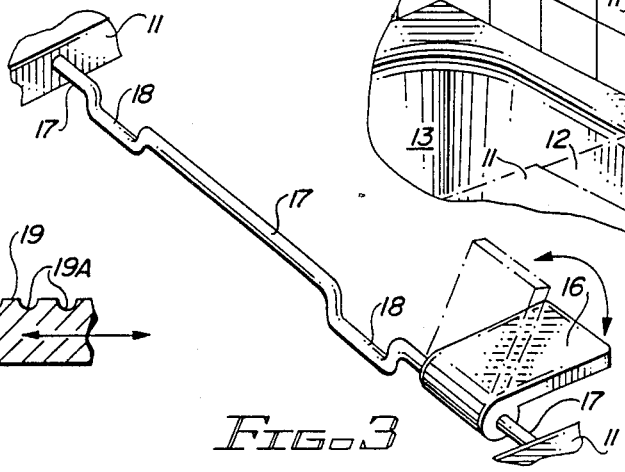
FIG. 3

PORTABLE, TRAVELER'S BATH SEAT

BACKGROUND

1. Field of the Invention

The invention relates to a bathing aid for use by persons who find it difficult or impossible to enter or exit a bathtub. In particular, the invention is an extendable seating board which may be adjusted to span a bathtub so that a person may sit on the board while bathing and showering.

2. Prior Art

As persons age, or become infirm, or incapacitated, it is often difficult for them to use a bathtub in the conventional manner. There is a need for apparatus which will permit a person to make use of the bathing and showering facilities provided by a bathtub even though such persons may not be able to readily enter or exit the tub.

C. D. Kenney, et al., sought a solution to this problem with their invention of a BATH CHAIR FOR INVALIDS on which Pat. No. 2,237,076 was issued in April of 1941. Their solution was to provide a supportive board which spanned the bathtub and had a seat adjustably mounted on the board. The seat included a back support and arm rests.

Many persons are not so incapacitated that they require a seat such as that disclosed by Kenney. For their purposes a simple board spanning the opening would be sufficient. The person wishing to bath could then sit himself on the board without having to lower himself into the tub. A disadvantage of the Kenney Bath Chair was that it was not conveniently portable. The supporting board was long enough to span the width of any standard bathtub. Thus, it could not be readily carried in a person's baggage if they were traveling. We are a nation of transients. The number of travelers having infirmities or physical incapacities grows each year as public awareness of the needs of these individuals forces changes in building codes and improvements in older structures to reduce the traveling burdens imposed upon these individuals and to ease as much as possible their use of the various facilities, entryways and passages of a building. The inventor is unaware of any innovative aids that have been made available to travelers who have difficulty in entering and exiting bathtubs. It is the intention of this invention to provide such travelers with portable means which they can conveniently carry with them on their travels for use as an aid in bathing and showering.

SUMMARY OF THE INVENTION

The invention is a seat which spans a bathtub and allows the person to sit thereon in order to bath and shower. The seat is comprised of an extendable support which spans across both sides of the bathtub. Because the support is extendable, it may be reduced to a minimal length for storage or transport.

In a preferred embodiment of the invention, one part of the support is a casing and the second part is a slide which slides in and out of the casing. The casing serves as a carrying case in which the slide is stored and transported. Finger insert grips facilitate handling. A locking mechanism is provided in any embodiment of the invention to lock the support at a given selected length. Thus, the support may be locked at its minimum-storage length as well as at the length selected for spanning the bathtub.

Once emplaced, spanning the bathtub, it is imperative that the support be maintained in position so as not to endanger the person seating thereon. To this end means are coupled to the support to keep it from moving along its longitudinal axis after it is emplaced spanning a bathtub.

In a presently preferred embodiment of the invention the wall adjacent one side of the tub inhibits movement of the support, in the direction of the wall, while pivoting arms extending downward into and adjacent the side of the tub away from the wall prevent movement of the support in a direction away from the wall.

Because motels, hotels, and the like may wish to provide the convenience of such a bathing seat in their establishments, an embodiment of the invention is provided which hingedly couples the support at the side of the tub adjacent the wall. Thus, when the support is not in use, it may be reduced to its minimal storage length and folded upward against the wall for storage.

DESCRIPTION OF THE DRAWINGS

FIG. 1 is a perspective view of the portable, traveler's bath seat in place, spanning a bathtub, so that a person may be seated thereon for purposes of bathing or showering.

FIG. 2 is a detailed perspective view of the portable, traveler's bath seat.

FIG. 3 illustrates an embodiment of the locking mechanism utilized to lock the extendable bath seat so as to maintain it at a fixed length.

FIG. 4 is a sectional view illustrating the manner in which the mechanism locks the slide board of the invention in place.

FIG. 5 is a similar sectional view showing the manner in which the locking mechanism is released to allow movement of the slide board.

FIG. 6 illustrates a suggested modification of the extendable bath seat of the invention which permits the bath seat to be permanently installed in bathtubs of hotels, motels, and the like.

A DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The invention is comprised of two spanning supports which are slide coupled together so that the assembly may be emplaced, spanning a bathtub. A person may then be seated on the assembly in order to bath or shower. This arrangement is shown in FIG. 1 in which the invention, an extendable bathroom seat, 10 is seen to comprise a first spanning support 11 configured as a sheath into which a second slide support 12 is inserted. Slide support 12 may be inserted fully within the first, sheath-like support 11 to provide an assembly of small enough size to readily fit within a briefcase or other luggage. This ability to reduce the length of the seat to such portable dimensions makes it convenient for travelers to carry with them, sheath-like support 12 serving as a carrying case to conveniently store and transport slide support 11. Finger insert grips 40 facilitate handling of bathroom seat 10.

Conversely, the ease with which slide support 12 may be extended from the sheath-like support 11 permits the length of the bath seat 10 to be adjusted so as to span a bathtub 13 so as to provide a person a seat at the approximate level of the top of the tub. In the illustration of FIG. 1 slide support 12 abuts wall 30 and so movement of seat 10 in the direction of the wall is inhibited. To prevent movement of seat 10 in a direction along its elongate axis, away from wall 30, legs 14, which are pivotally coupled to a sheathing support 11 by means of pivot pin 15, are provided. When legs 14 are pivoted downwardly as illustrated in FIG. 2, they will reside within tub 13 and impeded movement of seat 10 in a direction away from wall 30. This arrangement is illustrated in FIG. 1.

As has been disclosed to this point slide support 12 may be drawn fully within the sheath-type support 11 for purposes of storage and transport. In this case the sheath-type support 11 provides a carrying case for the bath seat 10. Slide support 12 may then later be withdrawn from case 11 and adjusted so that the bath seat will span the width of a bathtub. In either the instance in which the assembly of seat 10 is adjusted for minimal length or when extended for spanning a bathtub, it will be desirable that the assembly of the two sliding supports 11 and 12 be locked in place so that there is no inadvertent change in the desired length of the assembly. To this end lock actuating lever 16 is provided.

As is best illustrated in FIG. 3 lock actuating lever 16 is coupled to rotating locking rod 17, which in turn is coupled at either end to the case, or sheath-type support 11. (See 17 in FIGS. 1 and 2.) Rod 17 is deformed as shown at 18 to form a detente. This detente will interact with grooves 19A in slide support 12 to latch or release slide support 12 with respect to support 11.

FIGS. 1, 2, 4 and 5 illustrate slide 12 as having two rows of grooves illustrated in exaggerated detail as raised lands 19 and grooves or depressions 19A. As seen in the cross sectional view of FIG. 4, when release lever 16 is rotated downwards so as to be flush with the suface of support 11, locking rod 17 will be rotated so that it's detentes 18 will repose within one of a series of grooves 19A so as to inhibit any slide motion of support 12 within support 11.

This is the nominal position in which lock release lever 16 would be found and the assembly of the two sliding parts 11 and 12 will be in fixed position and the seat 10 may be used without fear of an inadvertent change in length of the assembly.

In the cross sectional view of FIG. 5, locking release lever 16 is shown in the raised position which causes rod 17 to rotate so as to raise detentes 18 from their engagement with grooves 19A in slide 12. Slide 12 may now be slide adjusted within the sheath-like embrace of support 11. As already indicated, the illustration of lands 19 and grooves 19A have been exaggerated for purposes of disclosure and a much finer groove arrangement will work satisfactorily with detente 18 to provide a locked assembly.

It is hoped that when the need of a seat such as the extendable bathing seat 10 is made known to Inn Keepers, they may wish to provide the convenience offered by seat 10 to their guests by installing an extendable bath seat permanently in the bathtubs of their inns, motels, and hotels. The illustration of FIG. 6, suggests the manner in which this may be done. A hinge 23 is coupled to slide support 12 and to tub 13 at plate 24. This arrangement will reduce the risk of theft of the bath seat from the facilities and yet allow the guest the ability to draw the seat downward away from the wall and extend it so it spans across the top of tub 13 so as to allow the guest to sit on the extended support assembly while bathing and showering.

What has been disclosed is a traveler's extendable bath seat made up of two parts which are slide coupled together so that the length may be minimized for storage and transport and extended to a length permitting it to span a bathtub. Safety locking devices are included to maintain the extendable bath seat at a fixed length and restrain it in position atop the tub.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. In apparatus having means for supporting a person on and above a bathtub whereby a person may sit above a tub to bathe and shower, the improvement comprising:

first and second spanning supports, said first spanning support being a carrying case in which said second spanning support is housed for storage and transport;

adjustment means for adjustably coupling said first spanning support to said second spanning support to form a coupled combination such that the elongate dimension of the coupled combination may be minimized for ease of transport and extended to span across a bathtub for seating thereon;

means coupled to at least one of said first and second spanning supports for inhibiting movement of the coupled combination of said first and second support, in a direction along the elongate axis of said combination when said combination is emplaced spanning a bathtub; and said means for inhibiting movement of said coupled combination comprises a locking leg pivotally coupled to at least one of said first and second spanning supports and extending downward adjacent an inner, non-wall-adjacent side of a tub across which said coupled combination is spanned.

2. The improvement of claim 1 further comprising locking means coupled to said adjustment means for locking said coupled combination in a selected elongate dimension.

3. The improvement of claim 2 further comprising:

a bathtub; and pivotal means rotatingly coupling said improvement to said tub.

4. The improvement of claim 1, said coupled combination further comprising:

a bathtub; and pivotal means rotatingly coupling said coupled combination to said bathtub whereby, after use of said coupled combination as a seat spanning said bathtub, said coupled combination may be rotated to a storage position.

5. Apparatus for supporting a person seated above a bathtub comprising:

an elongate casing; and an elongate support, slide coupled to and housed within said elongate casing, said casing further comprising a carrying case within which said support is stored and transported;

whereby said slide coupled casing and support may be slide-extended to span said bathtub so that a person may sit above the tub to bathe and shower, means coupled to at least one of said elongate casing and said elongate support for inhibiting movement in a direction along the elongate axis of said apparatus when said apparatus is placed spanning a bathtub; and said means for inhibiting movement of said apparatus comprises a locking leg coupled to at least one of said elongate casing and said elongate support and extending downward adjacent an inner, non-wall-adjacent side of said bathtub across which said apparatus is spanned.

6. The apparatus of claim 5 further comprising locking means coupled to said casing for locking said support and said casing in a selected, releasably coupled slide relationship.

7. The apparatus of claim 6 further comprising;

a bathtub; and pivotal means rotatingly coupling said apparatus to said bathtub whereby, after use as a seat spanning said bathtub, said apparatus may be rotated to a storage position.

8. The apparatus of claim 5 wherein said casing has finger insert means in a surface of said casing for gripping and handling said apparatus.

9. The apparatus of claim 8 further comprising lock means generally flush with a surface of said casing, said lock means further coupling said casing and said support for maintaining said support within said casing and at a selected slide-extended length therefrom.

10. The apparatus of claim 9 wherein said casing has a generally uniform cross section and is small enough overall to fit in a traveler's briefcase and luggage.

11. The apparatus of claim 5 further comprising lock means generally flush with a surface of said casing, said lock means further coupling said casing and said support for maintaining said support within said casing and at a selected slide-extended length therefrom.

12. The apparatus of claim 5 wherein said casing has a generally uniform cross section and is small enough overall to fit in a traveler's briefcase and luggage.

13. The apparatus of claim 5 wherein said casing has finger insert means in a surface of said casing for gripping and handling said apparatus.

14. A bathtub seat for supporting a person above a bathtub to bathe and shower comprising:

a bathtub;

a wall adjacent one side of said bathtub;

a carrying case;

a slide support, housed within said carrying case for storage and transport, and slide extendable from said carrying case, extendably spanning across said bathtub and having a first end adjacent said wall;

locking means coupled to said slide-extendable support for releasably locking said support in a selected length;

a second end of said slide-extendable support having coupled thereto means contacting said bathtub to inhibit movement of said support along an axis extending from said first end to said second end; and said means for inhibiting movement of said support comprises a locking leg pivotally coupled to said second end of said slide-extendable support and extending downward adjacent an inner, non-wall-adjacent side of said bathtub.

15. The bath seat of claim 14 further comprising pivotal means rotatingly coupling said first end of said slide-extendable support adjacent said wall whereby said support may be extended to minimal storage length and rotated for storage against said wall.

* * * * *